US005597251A

United States Patent [19]

Suzuki et al.

[11] Patent Number: 5,597,251

[45] Date of Patent: Jan. 28, 1997

[54] COLOR PRINTER

[75] Inventors: Yoshitaka Suzuki, Sugito-machi; Osamu Tajima; Morihiko Ota, both of Moriya-machi; Satoshi Yonemitsu; Masaki Takahashi, both of Yokohama, all of Japan

[73] Assignee: Victor Company of Japan, Ltd., Yokohama, Japan

[21] Appl. No.: 576,230

[22] Filed: Dec. 21, 1995

[30] Foreign Application Priority Data

Dec. 22, 1994 [JP] Japan ..... 6-336198

[51] Int. Cl.[6] ..... B41J 13/10

[52] U.S. Cl. ..... 400/645.4; 400/643; 101/409

[58] Field of Search ..... 101/408, 409, 101/410, 411, 412; 400/643, 645, 645.4; 271/82, 85, 268, 277

[56] References Cited

U.S. PATENT DOCUMENTS

| | | | |
|---|---|---|---|
| 4,990,933 | 2/1991 | Halakeyama et al. | 101/409 |
| 4,999,649 | 3/1991 | Saji et al. | 101/409 |
| 5,062,723 | 11/1991 | Takeda et al. | 400/643 |
| 5,325,777 | 7/1994 | Park | 101/409 |
| 5,362,043 | 11/1994 | Grellman . | |

FOREIGN PATENT DOCUMENTS

| | | |
|---|---|---|
| 61-137458 | 6/1986 | Japan . |
| 5-185676 | 7/1993 | Japan . |

*Primary Examiner*—Ren Yan
*Attorney, Agent, or Firm*—Michael N. Meller

[57] ABSTRACT

An image printing apparatus having high quality image printing capability due to minimized registration errors is provided. The image printing apparatus has a thermal head 18 and a platen roller 15 which is shorter in its circumference than the length of a pro-cut print medium 2 to be printed. An image is printed on the print medium by transporting the print medium and a ink ribbon 23 between the thermal head and the platen roller. A pair of clamp rings 3, 3 are rotatably and respectively provided approximately along both sides of the print medium, and each clamp ring has a circumference being same to or longer than the length pre-cut print medium, and has an internal gear **3*b*1. A clamper 5 is installed to connect the clamp rings together, and rotates with the print medium being clamped thereby. A capstan roller 7 is installed between the clamp rings and connected to a drive motor 8 to rotate constantly. A passively rotatable pinch roller 10** is installed and depressed to the capstan roller for transporting the print medium.

6 Claims, 8 Drawing Sheets

COLOR PRINTER

BACKGROUND OF THE INVENTION

1. Field of the Invention

The present invention relates to a printer that prints an image on a print medium by transferring ink from a ink ribbon to the print media and, more specifically, to a printer that comprises a platen roller of which the circumference is smaller than the length of the print medium, a capstan roller which clamps and transports the print medium, and a pinch roller.

2. Description of the Related Art

The related art will be explained with reference to FIGS. 1,2 and 3.

Generally, a color printer uses three-colored or four-colored ribbon, which contains yellow (Y), magenta (M), and cyan (C), or black (K) added to them, and obtains a color image by printing each of the above colors on a print medium. Basically, this kind of printer comprises a platen roller, a thermal head that is pressed to the platen roller, an ink ribbon and a print medium, both of them are transported between the platen roller and the thermal head to produce a color image.

FIG. 1 shows a schematic diagram of a color printer 100 of prior art having a platen roller 102 of which circumference is longer than a length of a print medium 101.

The platen roller 102 is driven by a platen motor (not shown) and can rotate around a shaft 103 in a direction of arrow. A clamper 104 lies across the surface of the platen roller 102, and cramps a leading edge of the print medium 101 that is fed by a media feeder (not shown) and wraps the print medium 101 around the platen roller 102. The platen motor drives the platen roller 102, which rotates in the allowed direction. An ink ribbon 105 is fed from a supply roll 106 and to a take-up roll 107. A thermal head 108 is depressed to the platen roller 102. Drivers (not shown) selectively energize a plurality of thermal elements 108*a* of the thermal head 108, and transfer ink from the ribbon 105 to the print medium 101. This is the way of this system for printing an image.

To obtain a color image, the ink ribbon 105 requires to be a four-colored ribbon, as shown in FIG. 2. Repeating an aforementioned process four times, a color image is produced.

FIG. 3 shows a schematic diagram of another color printer 200 of prior art that is disclosed in the Japanese Laid-Open Patent Publication H3-39271.

In the above mentioned color printer 200, a cylindrical sheet guide 202 is installed and has a longer circumference than the length of a print medium 201 in a direction of thereof. In the opening part 202*a* of the sheet guide 202, there is a platen roller 203 that has a shorter circumference than the length of a print medium 201, and can rotate. In both sides of the sheet guide 202, a pair of arms 204 is rotatably installed in a drive shaft 205. At the end of arms 204, a grip 204*a* is fitted and cramps the print medium 201.

The grip 204*a* cramps the end of the print medium 201 that is fed by a sheet feeder (not shown), and rotates along surface of the sheet guide 202 together with the arms 204 in the arrow direction. A ribbon film 206 is fed from a supply roll 207 to a take-up roll 208. The platen roller 203 rotates as the print medium 201 moves. A thermal head 209 is pressed to the platen roller 203. Drivers (not shown) selectively energize a plurality of thermal elements 209*a* of a thermal head 209 in response to the image data, and transfers ink onto the print medium 201 and finally produces an image. In the case of a four-colored ink ribbon 206, a color image is printed by repeating the rotation of both the print medium 201 and the arms 204 four times.

The diameter of the platen roller 102 has to be made large, as the circumference of the platen roller 102 of the color printer 100 is longer than the length of the print medium 101. It is difficult to make the large diameter platen roller 102, because it is difficult to produce a uniform hardness of, and to polish uniformly the surface of a rubber sheet that covers the platen roller 102.

Moreover, the large diameter platen roller 102 requires a large size of the thermal head 108, because it is necessary for a jut 108*b* not to touch to the surface of the platen roller 102. Thus, the distance from the thermal element 108*a* to the jut 108*b* is required to be large. This is an obstacle to a reduction of cost.

The color printer 200 of prior art has another problem.

In the color printer 200, there is no aforementioned problem, as the diameter of the platen roller 203 is smaller than the length of the print medium 201.

The cylindrical sheet guide 202 is stationary installed, and has a longer length of circumference than the length of the print medium 201. The surface of the sheet guide 202 is coated by a small friction material, such as Teflon (trade name), nevertheless, there occurs a friction between the print medium 201 and the sheet guide 202. This friction causes to change the transporting speed of the print medium 201, and generates a deviation of the print medium 201 from the correct position when an image is printed on the print medium 201. Especially, plural printing processes are required to get a color image, and the deviation of each process will differ one another. As a result, the image of each color that should be precisely positioned in a same place, is printed in different positions each other, thus the quality of color image is lost.

There is a further problem that is common to both the color printers 100 and 200. When the clamper 104 passes through between the thermal head 108 and the platen roller 102, the thermal head 108 should be lifted from the platen roller 102. This means that a driving mechanism is needed for lifting the thermal head 108, and the structure of the color printer 100 becomes complicated. This situation is the same with the color printer 200.

SUMMARY OF THE INVENTION

It is, therefore, a general object of the present invention to provide an improved color printer which is able to print a high quality color image and has a simple mechanical structure.

In accordance with the present invention, a platen roller and a thermal head which is movably installed are provided to a color printer. An ink film and a print medium are transported between the platen roller and the thermal head. The thermal head is depressed to the platen roller, and is electrically driven. Thereby the thermal head transfers ink from the ink ribbon to the print medium. Clamp rings each has a circumference having at least a same length as that of the print medium. The clamp rings are rotatably and respectively provided approximately along both sides of the print medium. These clamp rings have internal gears respectively. A clamper is installed to connect the clamp rings together, and rotates in combination with the clamp rings clamping the edge of the print medium. A capstan roller which is cylindrical is provided approximately parallel with the platen roller and extends along an inner surface of an imaginary cylinder made of the pair of clamp rings, and is connected to a driving source to rotate the clamp rings steadily. The capstan roller has a pair of small gears at the both ends, and rotates the clamp rings by meshing with the internal gears. A pinch roller is movably installed and transports the print medium at a constant speed by the constant rotation of the capstan roller, by being depressed to the capstan roller and holding the print medium together with the capstan roller. When printing is performed, the platen roller is positioned on an upstream side of the print medium transport, and is installed between the clamp rings. The platen roller is provided approximately parallel with the capstan roller and extends along an inner surface of an imaginary cylinder made of the pair of clamp rings. The platen roller has a shorter length in circumference than the length of the print medium, and rotates when the thermal head is depressed to the platen roller pinching the print medium therebetween and causing the constant transport of the print medium.

Thus, it is a feature of the present invention that the platen roller has a small diameter and the size of the thermal head is small, and, the capstan roller, the pinch roller, and the clamper cooperate to transport the print medium steadily.

It is another feature of the present invention that the ratio of the number of the teeth of the internal gear and the number of the teeth of the small gear is set to an integer.

It is still another feature of the present invention that a first cam which raises the pinch roller and a second cam which raises the thermal head are provided on the clamp rings where the clamper is installed close thereto, and the first and second cams are provided in order to raise the pinch roller after the thermal head is raised, and to lower the pinch roller before the thermal head is lowered when the clamper rotates with the clamp rings and passes through between the thermal head and the pinch roller.

BRIEF DESCRIPTION OF THE DRAWINGS

The above and other objects, Features and advantages of the present invention will be described hereinafter with reference to the accompanying drawings, in which like reference numerals are used to describe similar parts throughout the drawings of the invention, and wherein.

DETAILED DESCRIPTION OF THE PREFERRED EMBODIMENT

The present invention will now be described in detail with respect to the accompanying drawings.

Figure 4:
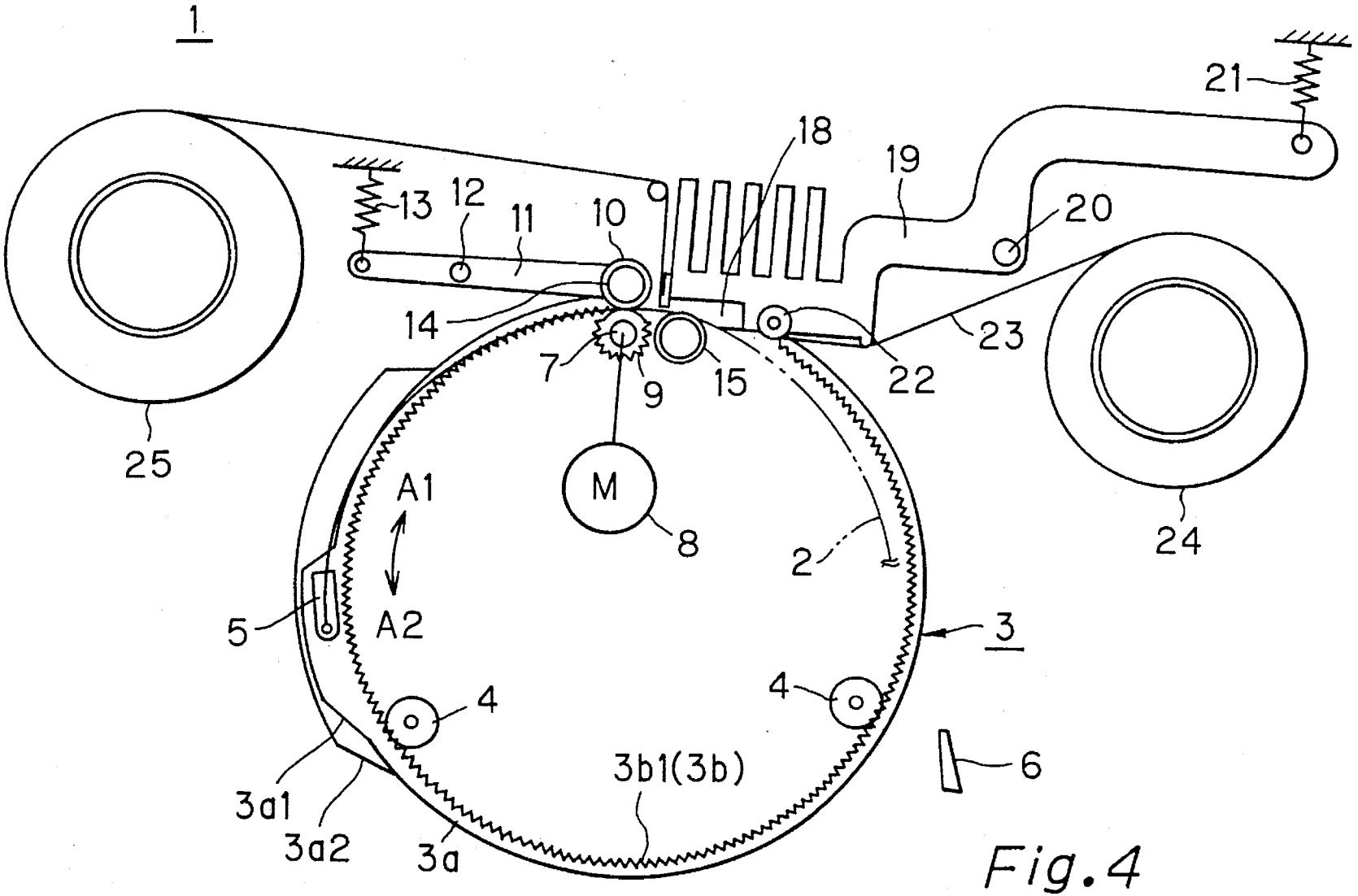
FIG. 4 shows a schematic diagram of a color printer of the present invention.
Figure 5:
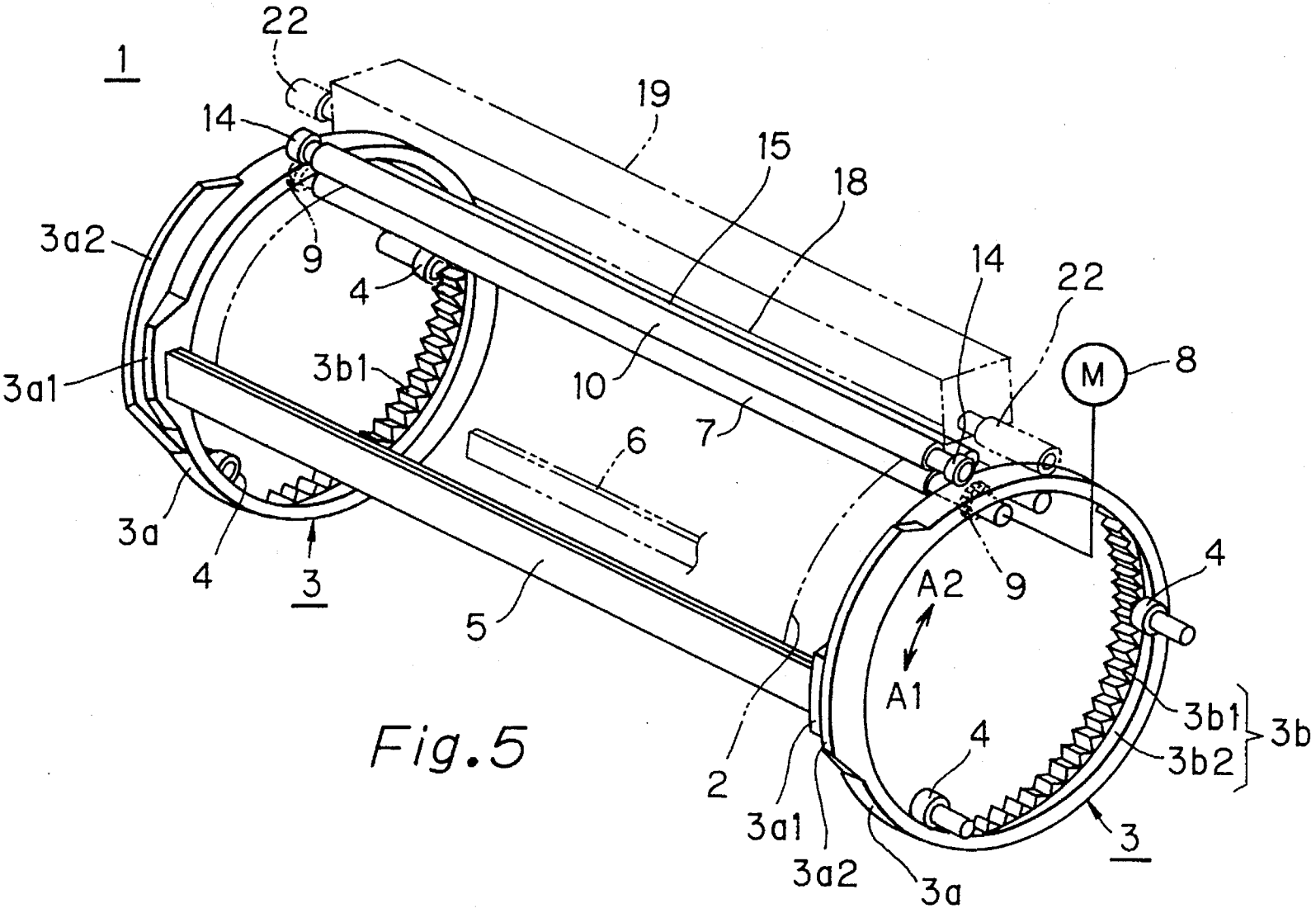
FIG. 5 shows a perspective view of the main parts of the color printer according to the present invention.

Referring to FIG. 4 and 5, a pair of clamp rings 3, 3 is rotatably provided approximately at a center of a color printer 1. The clamp rings 3, 3 are located respectively at the both sides of a print medium 2, and are separated each other, a distance between the clamp rings 3, 3 is wider than a width of the print medium 2.

The clamp ring 3 has a shape of ring. A circumference of outer edges 3*a*, 3*a* of the clamp rings 3, 3 is formed equal to or longer than a length of the print medium 2 which is pre-cut to the length. Inner edges 3*b*, 3*b* of the clamp rings 3, 3 have internal gears 3*b*1, 3*b*1. Inner surfaces 3*b*2, 3*b*2 are formed at an adjoining outside of the internal gears 3*b*1, 3*b*1. Circumferences of the inner surfaces 362, 362 are almost same respectively to pitch circles of the internal gears 3*b*1, 3*b*1 (shown in FIG. 5). A pair of small gears 9, 9 that are provided at the both ends of a spindle of a capstan roller 7 to be explained later always mesh with the internal gears 3*b*1, 3*b*1. Two pairs of guide rollers (4, 4), (4, 4) contact with the inner surfaces 362, 362 respectively. Accordingly, the pair of clamp rings 3, 3 are rotatably supported at three points by the small gears 9, 9 and two pairs of guide rollers (4, 4) , (4, 4) that divide the circumference of the inner edges 3*b*, 3*b* into three approximately equal parts. This allows the pair of clamp rings 3, 3 to rotate in directions of A1, A2.

A board clamper 5 connects the clamp rings 3, 3 at the outer edges 3*a*, 3*a*, and clamps an edge of the print medium 2. The clamper 5 rotates as a single body with the clamp rings 3, 3 clamping an edge of the print medium 2 that is fed by a feeder (not shown).

The clamper 5 is pulled by a spring (not shown) and is always ready to hold the edge of the print media. To feed a print medium 2, the clamper 5 rotates with a rotation of the clamp rings 3, 3 and opens to receive and clamp the edge of the print medium 2 when the clamper 5 touches an opener 6. After clamping the edge of the print medium 2, the clamper 5 departs from the opener 6. clamping the edge of the print medium 2.

First cams 3*a*1, 3*a*1 having a short circular arc shape are formed as portions of the outer edges 3*a*, 3*a*, and second cams 3*a*2, 3*a*2 that are having a long long circular arc shape are formed as additional portions of the outer edges 3*a*, 3*a*. The first and second cams (3*a*1, 3*a*1 and 3*a*2, 3*a*2) are offset but partly overlapped each other in a vicinity where the clamper 5 is installed. As shown afterwards, the first cams 3*a*1, 3*a*1 are used for raising a pinch roller 10 that is installed in a manner of contacting and separating with and from the capstan roller 7, and the second cams 3*a*2, 3*a*2 are used for raising a thermal head 18 from a platen roller 15 to be shown later.

The capstan roller 7 is connected by a belt (shown in FIG. 7) to a motor 8 that drives the capstan roller 7 in a constant speed. The capstan roller 7 is made of a rigid material such as stainless steel or other metal, and having a width slightly longer than the width of the print medium 2 which is precut to a predetermined length in a direction of transport thereof. The capstan roller 7 has relatively a small diameter.

Figure 6:
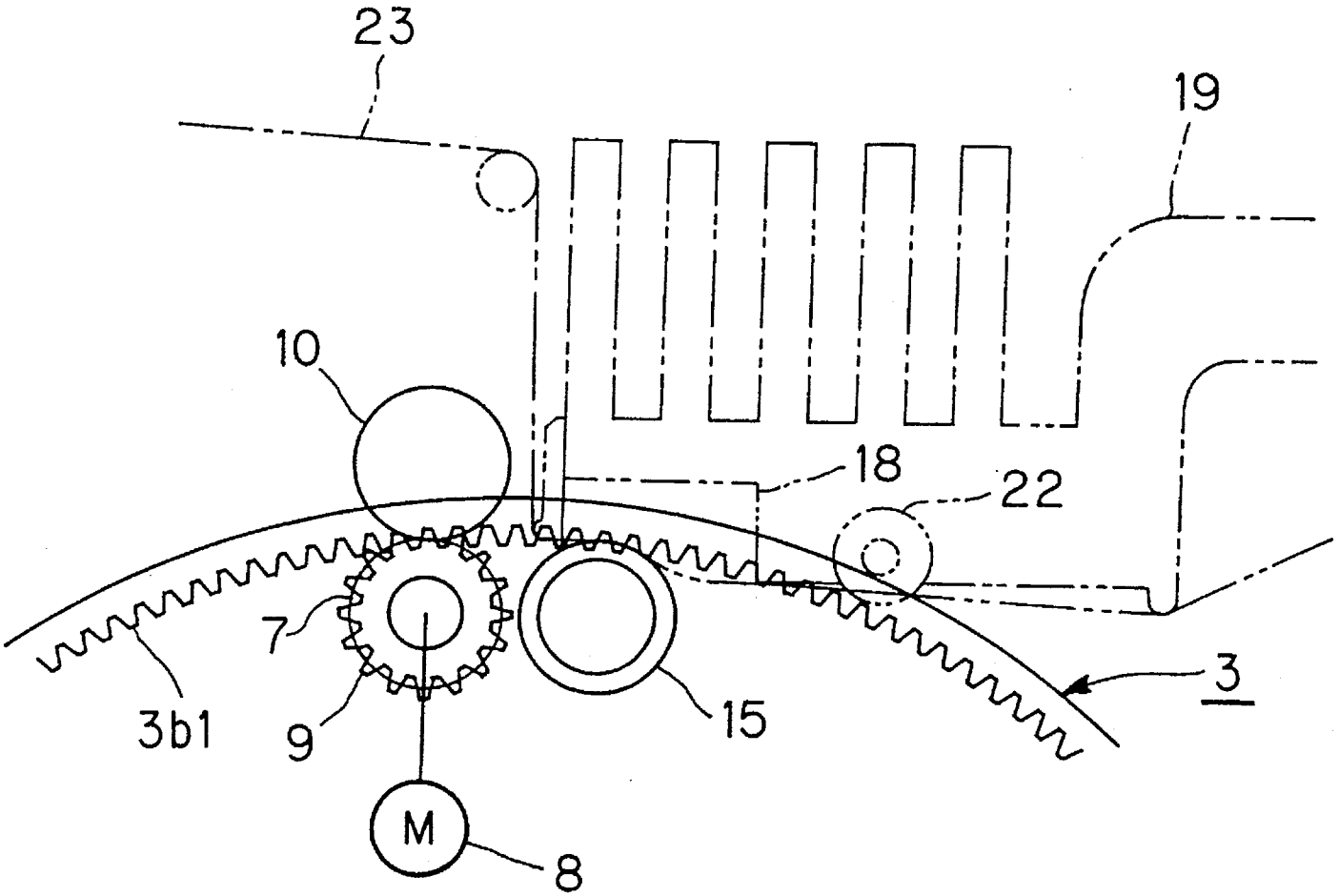
FIG. 6 shows a partially cutaway side view of a platen roller around of a capstan roller according to the present invention.
Figure 7:
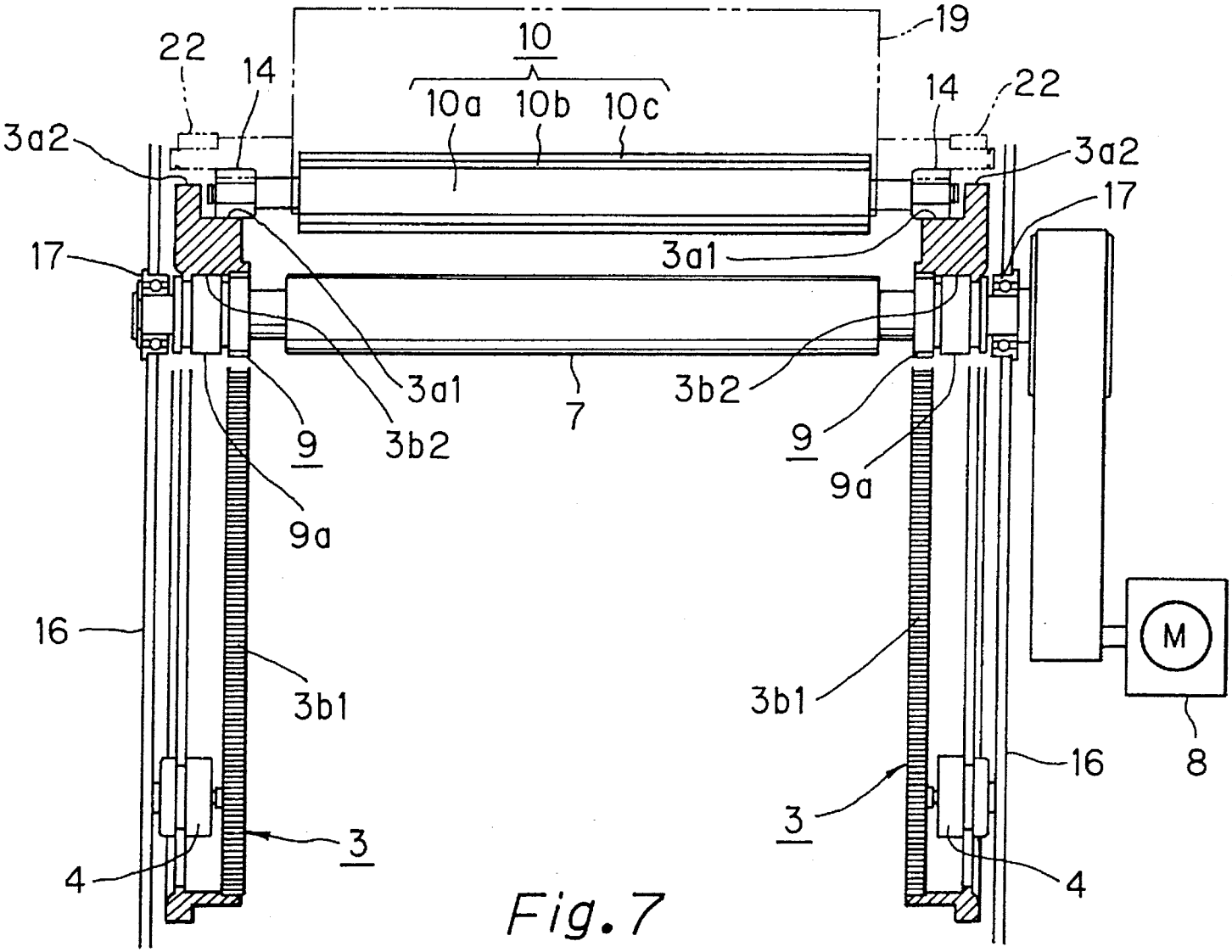
FIG. 7 shows a sectional side view that shows a proximity of the capstan roller and the platen roller according to the present invention.

As shown in FIGS. 6 and 7, a pair of small gears 9, 9 are provided at both ends of the spindle of the capstan roller 7. The small gears 9, 9 always mesh with the internal gears 3*b*1, 3*b*1 that are formed on the inner edges 3*b*, 3*b*, and rotate the clamp rings 3, 3 as the capstan roller 7 rotates constantly.

In the case that a number N1 of the teeth of the small gear 9 is 32, and a number N2 of the teeth of the internal gear 3b1 is 352, the ratio of N2/N1 is 11. When the ratio of N2/N1 is an integer as shown in the above, a tooth of the small gears 9, 9 of the capstan roller 7 always meshes with a same tooth of the internal gear 3b1 when the clamp rings 3, 3 are driven by the capstan roller 7. As a result, every cycle of the printing processes is kept in uniform state, for the reason that the same degree of rotation irregularity associated to the clamp rings 3, 3 and the small gears 9, 9, is repeated on each color printing process. Accordingly, each of the color images such as yellow (Y), magenta (M), cyan (C) and black (K) is printed at an exact position on the print medium 2 using an ink ribbon 23 (to be mentioned later). Thus, a high quality color image is obtained.

The capstan roller 7 is made of a metal, such as stainless steel, and has good rigidity that serves for transporting the print medium 2 in constant state in cooperation of a pinch roller 10.

The pinch roller 10 is provided parallel with the capstan roller 7, and has access to and is lifted from the capstan roller 7. The both ends of the pinch roller 10 are supported by an arm 11 that depresses the pinch roller 10 against the capstan roller 7 by a force exerted from a spring 13. The arm 11 is pivotted at a pivot 12.

The pinch roller 10, as shown in FIG. 7, is made from a metal shaft 10a that is covered by a rubber material 10b, and further covered with a material having a smaller coefficient of friction than that of rubber, such as Teflon (trade name) tube 10c. The coefficient of friction of Teflon is smaller than 0.5.

In operation, the pinch roller 10 is depressed to the capstan roller 7, and holds the print medium 2 therebetween. The print medium 2 is transported in constant speed by a constant rotation of the capstan roller 7 and the pressure caused in a space between the pinch roller 10 and the capstan roller 7. The small coefficient of friction of Teflon tube 10c lessens a frictional resistance developed during a transport of the print medium 2. As a result, the print medium 2 is transported precisely in constant speed in the direction of A1 (FIG. 5).

Figure 1:
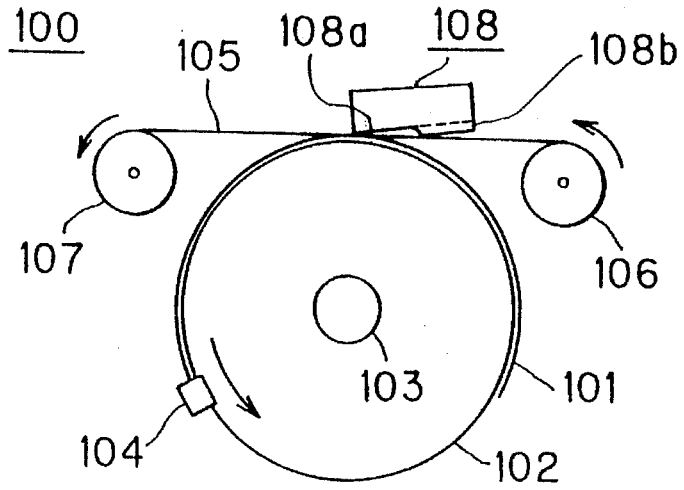
Fig.1 PRIOR ART
FIG. 1 shows a schematic diagram of a color printer of prior art.

Now referring to FIGS. 1 and 7, rollers 14, 14 are rotatably provided at the both ends of the pinch roller 10. When the clamper 5 rotates in the direction of A1 and passes by the pinch roller 10, the rollers 14, 14 contact with the first cams 3a1, 3a1, and the pinch roller 10 is lifted away from the capstan roller 7. The rollers 14, 14 are lifted away from the outer edges 3a, 3a during the pinch roller 10 is depressed on the capstan roller 7.

The platen roller 15 is rotatably provided near the capstan roller 7 and is positioned on an upstream side of the print medium 2 transport, as seen in FIG. 4. The platen roller 15 which is proposed between the clamp rings 3, 3 extends along an inner surface of an imaginary cylinder made of the pair of clamp rings 3, 3. The platen roller 15 is made from a metal cylinder covered with rubber, and its circumference is smaller than the length of the print medium 2. The platen roller 15 is not positively driven by a driving source, and supported by bearings 17, 17 that are mounted on a case 16. As the print medium 2 is transported, the thermal head 18 is depressed to the platen roller 15, and this pressure applied an ink ribbon 23 and the print medium 2 makes the platen roller 15 passively rotate.

Referring now to FIGS. 4 and 5, the thermal head 18 is provided parallel with the platen roller 15 in a contacting and separating manner. The thermal head 18 is supported by an arm 19 which is allowed a rocking motion around a supporting shaft 20. The thermal head 18 is biased by a spring 21 which causes the arm 19 to swing in a counterclockwise direction around the supporting shaft 20, thus the thermal head 18 is depressed to the platen roller At the both ends of the arm 19, rollers 22, 22 are rotatably provided. When the clamper 5 that is installed on the outer edges 3a, 3a, rotates in the A1 direction and passes by the thermal head 18, the rollers 22, 22 ride on the second cams 3a2, 3a2, and this action causes that the thermal head is lifted from the capstan roller 7.

Under the condition that the thermal head 18 is depressed to the platen roller 15, the rollers 22, 22 are lifted from the outer edges 3a, 3a.

Figure 8:
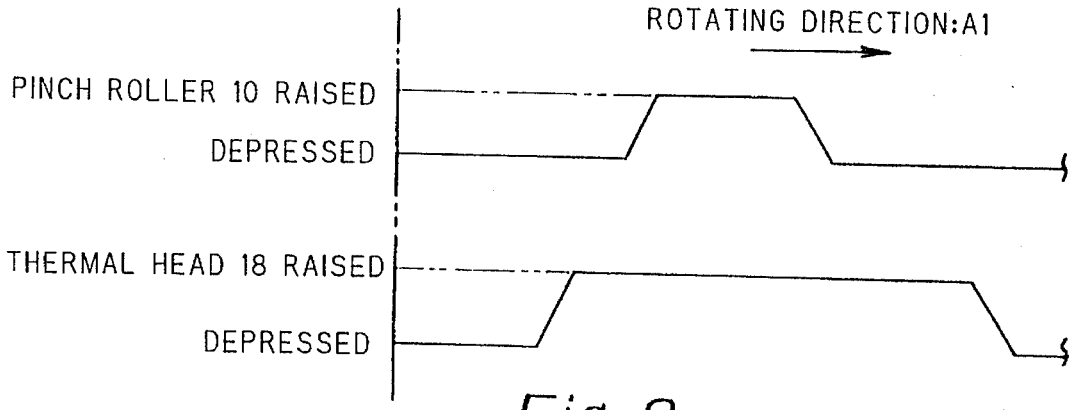
FIG. 8 shows a time table that shows timings of pressing and lifting of a pinch roller and a thermal head respectively according to the present invention.

When the clamper 5 passes by the thermal head 18, the pinch roller 10 is lifted from the capstan roller 7, and the thermal head 18 is lifted from the platen roller 15. Timing relation of these actions are shown in FIG. 8, and these waveforms and timings correspond with shapes of the first cams 3a1, 3a1 and of the second cams 3a2, 3a2.

Accordingly, the clamper 5 rotates in the direction of A1, and the pinch roller 10 is lifted after the thermal head 18 is lifted. On the other hand, the shapes of the first cams 3a1, 3a1 and of the second cams 3a2, 3a2 are formed respectively in order that the pinch roller 10 is depressed on the capstan roller 7 earlier than the thermal head is depressed on the platen roller 15. Because of this arrangement, the platen roller 15 has no need of being positively driven. Moreover, there is no need of an actuator lifting the pinch roller 10 and the thermal head 18. Thus, the cost of the color printer 1 is significantly less than that of conventional printers.

While the pinch roller 10 is lifted from the capstan roller 7 and the thermal head 18 is lifted from the platen roller 15, the rollers 14, 14 ride on the first cams 3a1, 3a1 and further the rollers 22, 22 are depressed on the second cams 3a2, 3a2. These pressure on the clamp rings 3, 3 is generated by the small gears 9, 9 being driven. At the both outer sides of the small gears 9, 9, cylinders 9a, 9a are formed, as seen in FIG. 7. The diameters of the cylinders 9a, 9a are almost same as that of the small gears 9, 9. The aforementioned pressure on the clamp rings 3, 3 is reduced by a distribution of the force, as the cylinders 9a, 9a always contact to the inner surface 362, 362. Accordingly, the pressure which is caused by the pinch roller 10 and by the thermal head 18 is weakened to the small gears 9, 9 and the internal gears 3b1, 3b1.

Figure 2:
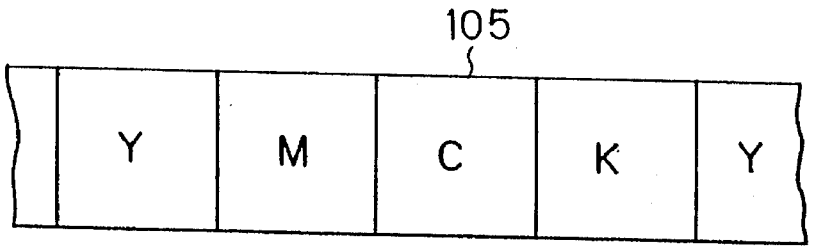
FIG. 2 shows a part of a ribbon for a color printer.
Figure 3:
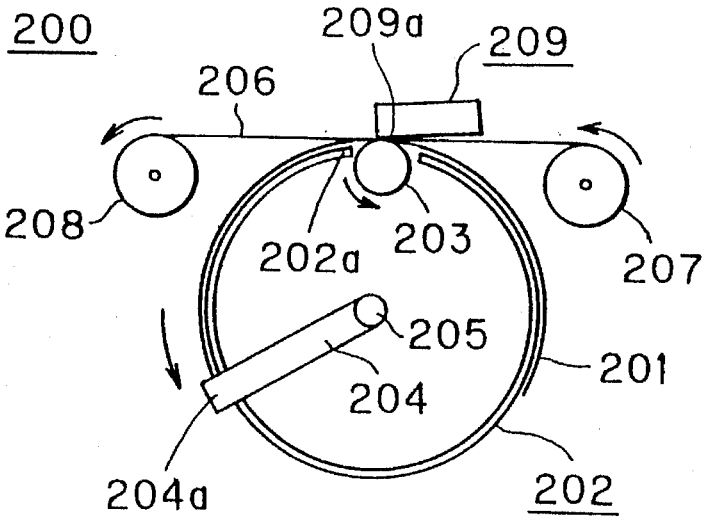
Fig.3 PRIOR ART
FIG. 3 shows a schematic diagram of another color printer of prior art.

The ink ribbon 23 is fed from a supply roll 24, through the gap between the thermal head 18 and the platen roller 15, to a take-up roll 25, without contacting the capstan roller 7 and the pinch roller 10. The ink ribbon 23 consists of three colors, such as yellow (Y), magenta (M), cyan (C), or of four colors, such as (Y), (M), (C) and black (K) as seen in FIG. 2. To print a color image on the print medium 2, the clamper 5 rotates in the direction of A1, with clamping the edge of print medium 2, and the thermal head 18 depresses the ink ribbon 23 on the print medium 2 which is disposed between the head 18 and the platen roller 15. When the printing is performed, the thermal head 18 is raised. The desired color image is completed by repeating these processes on the print medium 2.

Referring now to FIGS. 9–13, the present invention will be described.

Figure 9:
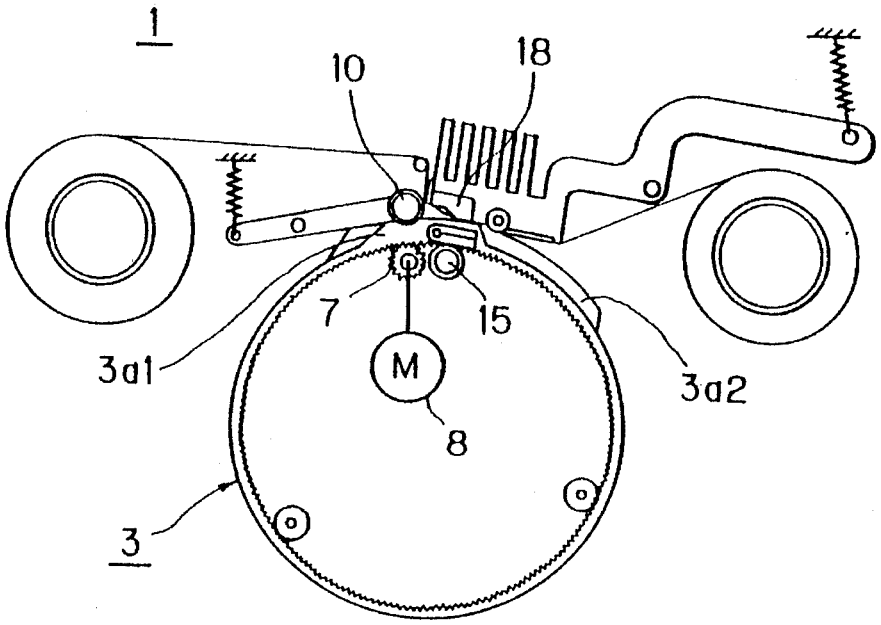
FIGS. 9–13 show side views that explain the movement of the color printer according to the present invention.

FIG. 9 shows a standby stage of the printing operation of the color printer 1. The capstan roller 7 that is connected with the motor 8, and the pair of clamp rings 3, 3 are standing still. The pinch roller 10 is raised away from the capstan roller 7 by the first cam 3a1, and the thermal head 18 is raised away from the platen roller 15 by the second cam 3a2. As a result, permanent deformation of the capstan roller 7 and the platen roller 15 are protected.

Figure 10:
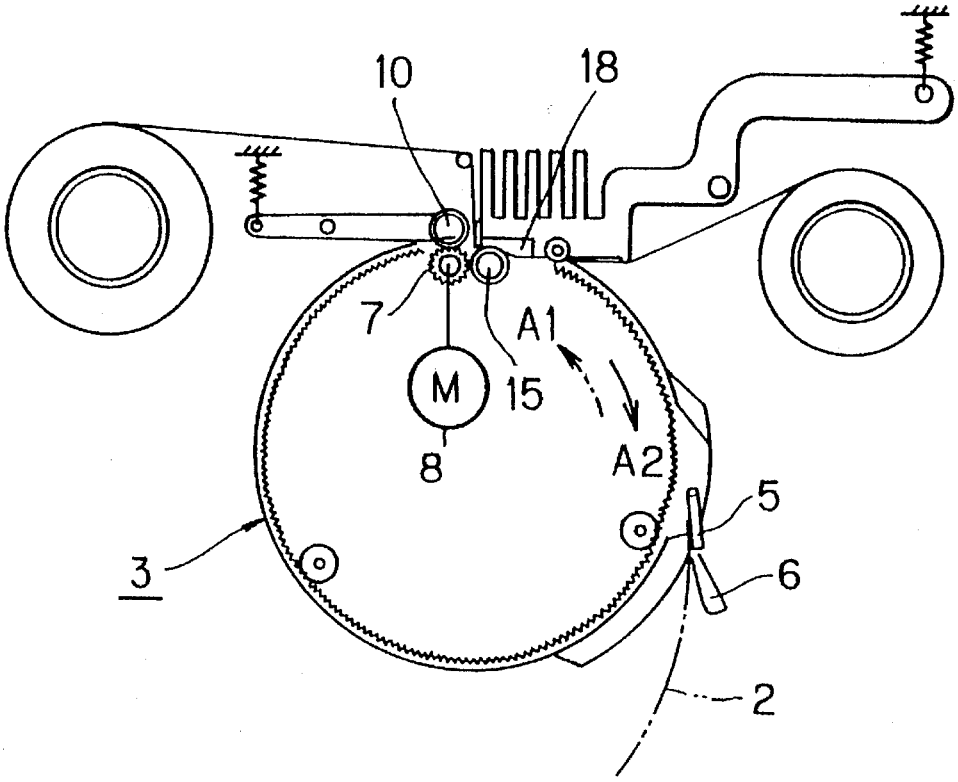

FIG. 10 shows a first stage of the operation. The motor 8 drives the clamp rings 3, 3 in the direction of A2, and the clamper 5 contacts to the opener 6 to open thereof, and then, the edge of the print medium 2 is inserted into the clamper 5. After this, the clamp rings 3, 3 continue to rotate in the direction of A2, and then, the clamper 5 separates from the opener 6 and clamps the edge of the print medium 2. The pinch roller 10 is depressed on the capstan roller 7, and the thermal head 18 is depressed on the platen roller 15, as the first cam 3a1 and the second cam 3a2 rotate.

Figure 11:
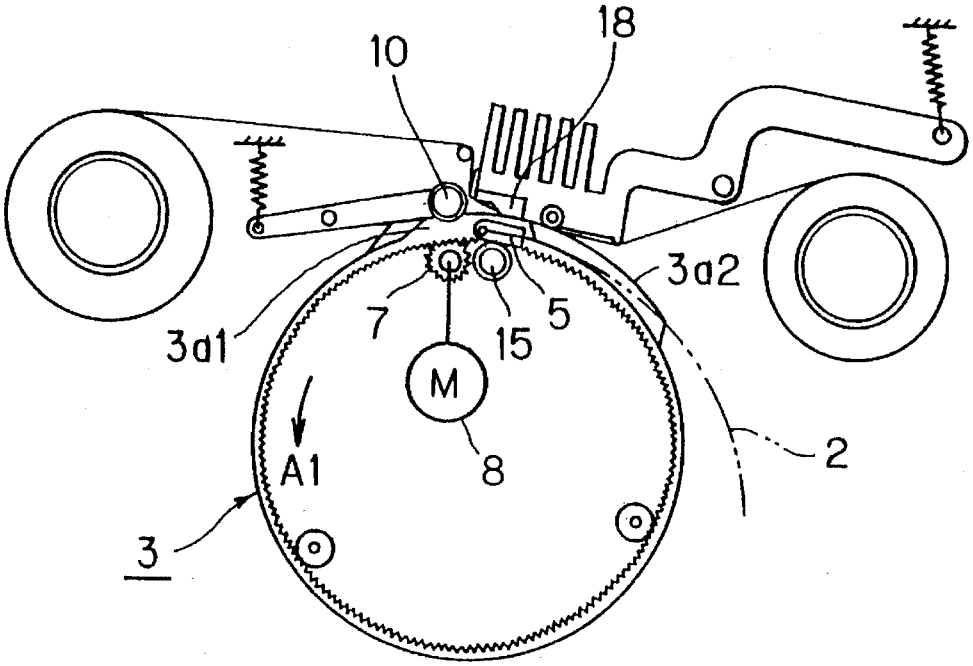

FIG. 11 shows a second stage of operation. The clamper 5 rotates in the direction of A1, having the print medium 2 being clamped. At first, the second cam 3a2 raises the thermal head 18 from the platen roller 15, then, the first cam raises the pinch roller 10 from the capstan roller 7.

Figure 12:
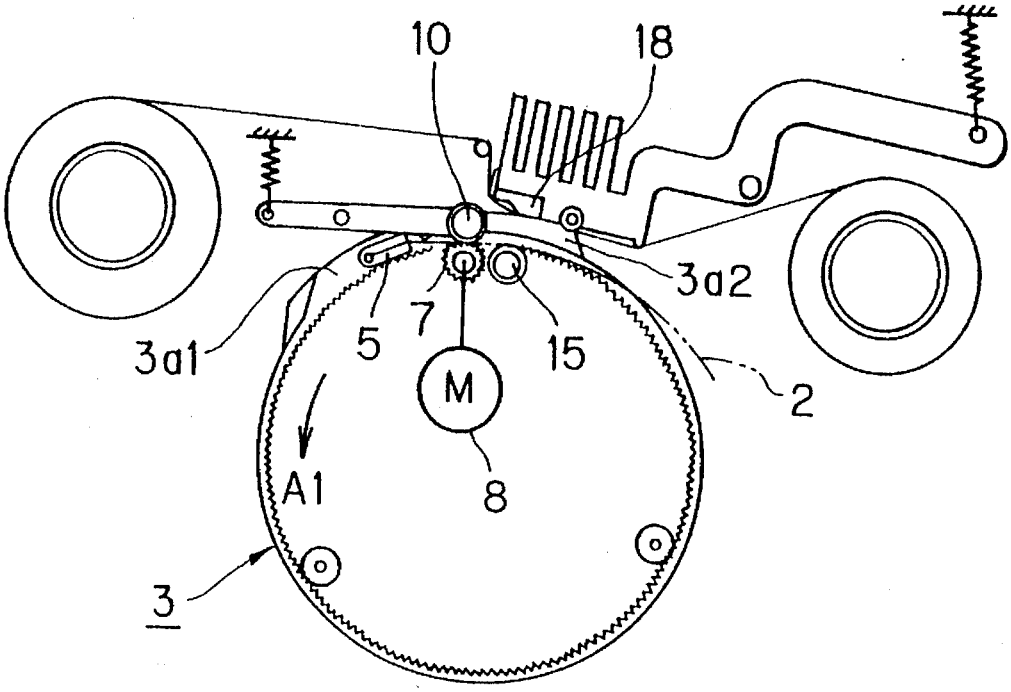

FIG. 12 shows a third stage of operation. The clamper 5 further rotates in the direction of A1, with the print medium 2 being clamped. Then, the pinch roller 10 is depressed to the capstan roller 7, where the print medium 2 is interposed between the pinch roller 10 and capstan roller 7. The print medium 2 is transported at a constant speed by the constant rotation of the capstan roller 7 in the direction of A1.

In this stage, the thermal head 18 is still depressed on the platen roller 15.

Figure 13:
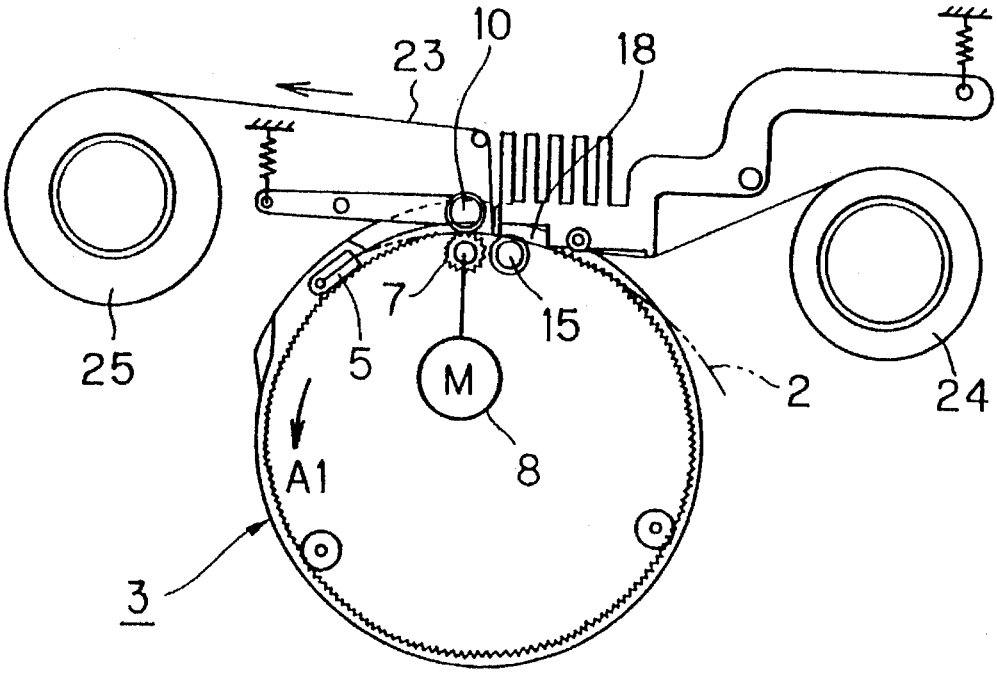

FIG. 13 shows the final stage of operation. The clamper 5 further rotates in the direction of A1, holding the print medium 2 on the capstan roller 7. The print medium 2 is transported at a constant speed in the direction of A1. The thermal head 18 is depressed to the platen roller 15. The ink ribbon 23 is fed from the supply roll 24 to the take-up roll 25 threaded between the print medium 2 and thermal head 18. A plurality of heating elements (not shown) that are installed on the thermal head 18 are selectively heated, and transfer ink from the ink ribbon 23 to the print medium 2. In the case of the ink ribbon being a four-colored ribbon as shown in FIG. 2, the aforementioned process is repeated four times to obtain a single complete color image. Thus, a high quality color image is obtained.

After the color image is printed, the clamper 5 is rotated in the direction of A2 to release the print medium 2 from the clamper 5 by the opener 6, and an ejector (not shown) ejects the print medium 2 to an outside of the printer 1.

As mentioned in the foregoing, an advantage of this invention is that accurate registration of a image is derived.

Another advantage of this invention is that friction associated in the printing mechanism is kept very small in this apparatus.

Still another advantage is that it is easy to manufacture this apparatus.

Yet another advantage is that this apparatus requires only one driving source.

What is claimed is:

1. An image recording apparatus comprising:

a thermal head;

a capstan roller;

a platen roller having a circumference which is shorter than a length of a print medium which is pre-cut to said length;

a pinch roller for transporting said print medium with said pinch roller being driven by a constant rotation of said capstan roller, and with said print medium being held between said pinch roller and said capstan roller;

printing means for printing an image on said print medium by transporting an ink ribbon and said print medium between said thermal head and said platen roller;

a pair of clamp rings each having a circumference which has at least a same length as that of said print medium, said clamp rings rotatably installed respectively and correspondingly with ends of said thermal head; and a clamper being connected with said pair of clamp rings for clamping said print medium, and for rotating said print medium together with said clamp rings and for printing said image on said print medium.

2. An image recording apparatus according to the claim 1 further comprising:

cams being formed on said clamp rings respectively;

said clamper being connected with said clamp rings in a vicinity of said cams; and said cams raising said thermal head from said platen roller when said clamp rings rotate and said clamper having said print medium being clamped passes through a space defined by said thermal head and said platen roller.

3. An image recording apparatus according to claim 1 further comprising:

cams being formed on said clamp rings in a proximity of said clamper; and said cams raising said pinch roller from said capstan roller when said clamp rings rotate and said clamper having said print medium being clamped passes through said pinch roller.

4. An image recording apparatus comprising:

a platen roller;

a thermal head means for printing an image on a print medium which is pre-cut to a length by transferring ink from an ink ribbon by depressing said thermal head toward said platen roller;

a pair of clamp rings each having a circumference which has at least a same length as that of said print medium, said clamp rings rotatably and respectively provided approximately along both sides of said print medium to be transported, said clamp rings respectively having internal gears;

a clamper being installed to connect said clamp rings, and rotating together with said clamp rings for clamping an edge of said print medium;

a capstan roller installed between said clamp rings so as to inscribe said clamp rings at both ends thereof and connected to a driving source so as to be rotated at a constant speed, said capstan roller having small gears respectively at both ends thereof, for rotating said clamp rings by meshing with said internal gears;

a pinch roller movably and rotatably installed on said image recording apparatus, said pinch roller being depressed toward said capstan roller for transporting said print medium, with said print medium being interposed between said pinch roller and said capstan roller for movement at a constant speed caused by a constant rotation of said capstan roller; and said platen roller being positioned adjacent to said capstan roller on an upstream of a flow of said print medium, said platen roller being installed between said clamp rings so as to inscribe said clamp rings at both ends thereof, said platen roller having a shorter length of circumference than said length of said print medium, and passively rotating when said thermal head is biased against said platen roller with said print medium being transported therebetween.

5. An image recording apparatus according to the claim 4, wherein first cam means for raising said pinch roller and second cam means for raising said thermal head, are formed on each of said clamp rings in a vicinity of said clamper in such a way that said pinch roller is raised after said thermal head is raised, and said pinch roller is lowered before said thermal head is lowered when said clamper rotates with said pair of clamp rings and passes between said thermal head and said pinch roller.

6. An image recording apparatus according to the claim 4, wherein the ratio of a number of gear teeth of said internal gear and a number of gear teeth of each of said small gear is set to an integer.

* * * * *